United States Patent [19]

Toyota et al.

[11] 4,201,522

[45] May 6, 1980

[54] BOOST-RETARDING DEVICE FOR ELECTROMAGNETIC PLUNGER PUMP AND THE LIKE

[75] Inventors: Akira Toyota, Tokyo; Katsumi Nozawa, Yokohama; Hideo Nomura, Fujisawa, all of Japan

[73] Assignee: Taisan Industrial Co., Ltd., Tokyo, Japan

[21] Appl. No.: 902,940

[22] Filed: May 4, 1978

[30] Foreign Application Priority Data

Jul. 8, 1977 [JP] Japan ..... 52-80998

[51] Int. Cl.[2] ..... F23N 1/00; F04B 49/02

[52] U.S. Cl. ..... 417/311; 123/139 AS; 138/31; 417/540; 431/38

[58] Field of Search ..... 123/139 AS, 139 AF; 417/540, 542, 307, 309, 311; 138/31; 431/38

[56] References Cited

U.S. PATENT DOCUMENTS

| | | | |
|---|---|---|---|
| 1,861,154 | 5/1932 | Dorman | 138/31 |
| 2,673,527 | 3/1954 | Ashton et al. | 138/31 X |
| 3,936,235 | 2/1976 | Larsen | 417/279 |
| 4,021,152 | 5/1977 | Toyoda | 417/417 |
| 4,102,630 | 7/1978 | Edman | 431/38 X |

*Primary Examiner*—Leonard E. Smith

*Attorney, Agent, or Firm*—Laff, Whitesel & Rockman

[57] ABSTRACT

A pump has a boost-retarding device which comprises a cylinder communicating between the suction side and the discharge side of the pump. A plunger slidably and reciprocatingly fits into the cylinder and a lead passage communicates between the suction side and the discharge sides which are divided by the plunger. An adjustable spring biases the plunger toward the discharge side, and a valve mechanism cuts off the outflow of a liquid, from the discharge side to the suction side, which outflow occurs responsive to a movement of the plunger toward the suction side.

32 Claims, 10 Drawing Figures

P Kg/cm²
t sec

BOOST-RETARDING DEVICE FOR ELECTROMAGNETIC PLUNGER PUMP AND THE LIKE

BACKGROUND OF INVENTION

This invention relates to a boost-retarding device for use on electromagnetic plunger pumps and more particularly for pressure-feed pumps of a fuel oil to pressure-feed injection type burner (a so-called "gun type" burner).

The inventive boost-retarding device slowly retards the discharge pressure rise and reduces the ignition detonation noise of the fuel at the start of operation of the burner.

The inventors of this invention previously disclosed a method of reducing the ignition detonation noise at the start of operation of a pump in Japanese application No. 20,322/1977. This prior art method contemplates an ignition when there is a small discharge flow. To reduce the ignition detonation noise at the start of pump operation, the fuel oil is thottled by means of a cut-off valve disposed on the discharge passage, the fuel oil is gasified, and a part of the oil is compressed with the resulting gas, to cause a time-lag in the pressure transmission characteristics of the fuel oil.

However, it is not easy to set the boost-retarding time of the discharge pressure to an optional value in the above-described method. In addition, that method is not free from the drawback that the cut-off valve performs its cut-off action when the pump stops operating. Then, it leaves a residual pressure on the discharge side and consequently, requires means such as a discharge valve for removing the residual pressure.

An object of the present invention is to improve boost-retarding devices by easily and accurately setting the boost-retarding time at the start of operation of the pump to a desired value.

Another object of the present invention is to easily and accurately set a discharge pressure on a boost-retarding device for an optimum ignition timing and to a desired value.

Yet another object of the present invention is to provide a boost-retading device which does not leave any residual pressure on the discharge side of a pump after it stops operating. Still another object is to eliminate an "after-drip" of the fuel oil from an injection nozzle. A further object is to relieve residual pressure, if any, via a cut-off valve mechanism in a passageway extending from the suction side of the pump. A still further object is to accurately return a plunger to its normal position, when the pump stops.

It is still another object of the present invention to provide a boost-retarding device which ensures stable sucking and discharging actions of the pump at the start of operation and prevents overflow of the fuel oil from the discharge side to a fire chamber, even when the pump stops operating.

Another object of the present invention is to smooth the discharge pulsations of the pump, and to afford a buffer and accumlator action which enhances the efficiency of the pump.

It is yet another object of the present invention to provide a boost-retarding device which can optionally set and adjust a constant discharge pressure of the pump to a desired value.

BRIEF DESCRIPTION OF THE DRAWINGS

The present invention will be made more apparent with reference to the preferred embodiments shown in the accompanying drawings, wherein:

FIG. 4' is a partial-cross section of an embodiment of a leak passage that bypasses a plunger.

DETAILED DESCRIPTION OF THE INVENTION

Figures 1, 2, 3, 4, 5:
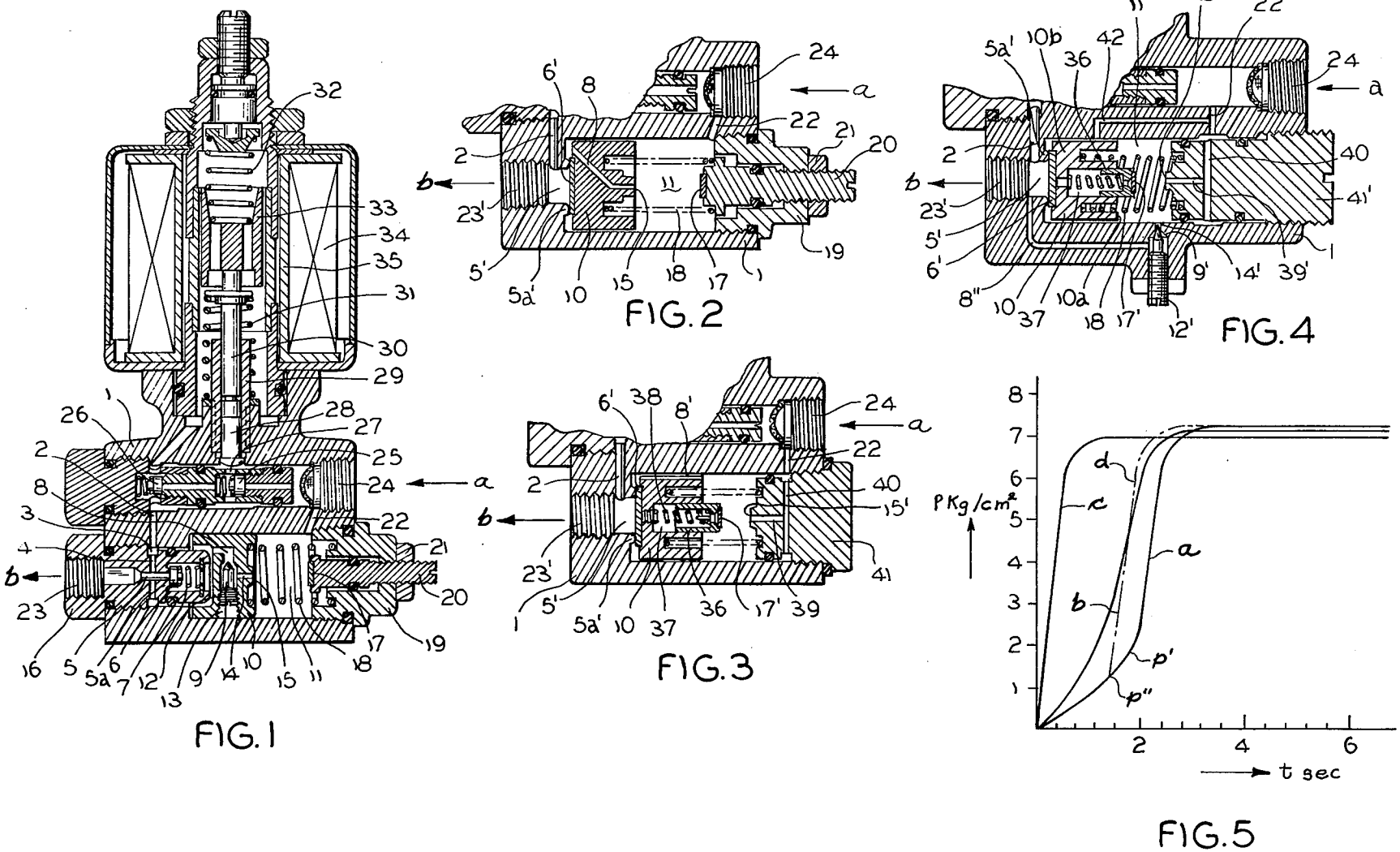
FIG. 1 is a longitudinal cross-section of an electromagnetic plunger pump equipped with the boost-retarding device in accordance with the present invention.
FIG. 2 is a partial cross-section of another embodiment of the boost-retarding device in accordance with the present invention.
FIG. 3 is a partial cross-section of another embodiment of the boost-retarding device in accordance with the present invention.
FIG. 4 is a partial cross-section of another embodiment of the boost-retarding device in accordance with the present invention.
FIG. 5 is a chart showing the discharge pressure rise characteristic curves of an electromagnetic plunger pump equipped with the boost-retarding device of the invention and an electromagnetic plunger pump not equipped with the same.
Figure 4:
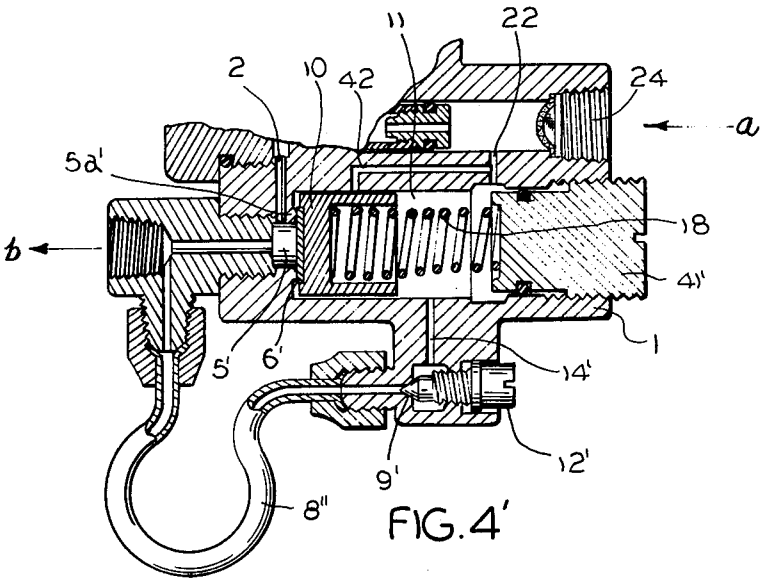
Figure 3A:
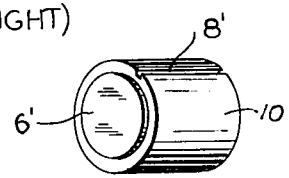
FIG. 3*a* is a perspective view of an embodiment of a leak passage formed around the outer circumference of a plunger.
Figure 3B:
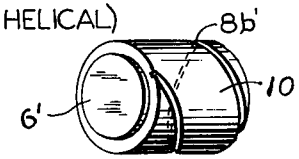
FIG. 3*b* is a perspective view of an embodiment of a helical groove leak passage formed around the outer circumference of a plunger.
Figure 3C:
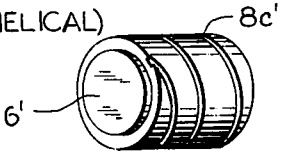
FIG. 3*c* is a perspective view of an embodiment of a helical groove leak passage formed around the outer circumference of a plunger.
Figure 3D:
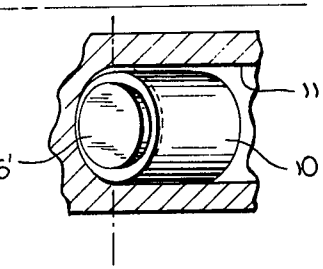
FIG. 3*d* is a perspective view of an embodiment of a sliding gap leak passage formed between a cylinder and a plunger.

Referring now in detail to the drawings, FIG. 1 shows a longitudinal cross-section of an electromagnetic plunger pump equipped with the boost-retarding device in accordance with the present invention. The plunger 10 is slidably and reciprocatingly fitted into a cylinder 11 formed inside a main body 1 and divides the cylinder 11 into the discharge side and the suction side. Communicating ducts 5 and 22 communicate with the discharge side and the suction side of the cylinder 11 with a discharge port 23 and a suction port 24 of the electromagnetic plunger pump, respectively. Leak holes 8 and 4 are bored on the plunger 10 to communicate with the discharge side and the suction side, respectively. A valve seat 15 is formed so that the leak hole 14 is open to the center of axis of the edge surface on the suction side of the plunger 10.

A valve seat 9 is provided at the principal section of the leak hole 8 and a hole 13 is threaded inside the plunger 10 so as to correspond to the valve seat 9. An adjusting valve 12 is turned into the threaded hole 13. By turning this valve 12, it is possible to adjust an opening (a small gap) defined between it and the valve seat 9 to control leakage from the discharge side to the suction side. A valve cover 19 is hermetically attached to a threaded edge section of the cylinder 11 on the suction side. An adjusting spring 18 is interposed under compression between the valve cover 19 and the plunger 10 to press the plunger 10 toward the discharge port 23.

A valve stem 20 is coaxially and hermetically mounted on the valve cover 19 and equipped at its tip with a valve 17 that engages with the above-mentioned valve seat 15. The valve seat 15 and the valve 17 together form a valve mechanism. They engage each other when the plunger 10 operates under the discharge pressure and moves toward the suction side. This closes the leak holes 8 and 14, thereby cutting off and preventing leaking of a fluid from the discharge side to the suction side, through the leak holes 8 and 14.

The valve stem 20 also functions as a stopper which restricts the movement of the plunger 10 toward the suction side. This valve stem 20 is rotated along the threaded passage through the valve cover 19, thus, a rotational adjustment from the outside causes a retraction of the valve tip 17 of the valve stem 20. This adjusts the opposed distance between the valve seat 15 and the valve 17, that is to say, the movement distance of the plunger until the valve seat 15 is closed.

The communicating duct 5 is formed on a threaded discharge joint coupling 16 that is secured to the discharge side of the pump, and communicates with the discharge port 23. A valve seat 5*a*, having this communicating duct 5, is allowed to engage with a valve 6 that is biased by a spring 7. This forms a check valve which is opened or closed in the direction of the discharge port 23. This check valve 6 is necessary because if not provided, the discharge port 23 and the suction port 24 are always kept open through the small gap between the cylinder 11 and the plunger 10, the leak holes 8, 14 and the communicating ducts 5 and 22, whereby the pump does not cause sucking and discharge actions even when it is actuated. Moreover, when a feed liquid tank is located at a position higher than the position of installation of the pump, the fuel oil flows to the discharge side through the above-mentioned communicating ducts and causes over-flow to a fire chamber, thereby incurring extreme danger, even when the pump is stopped.

The check valve 6 is provided in order to eliminate this problem. However, the check valve 6 may be deleted in such cases where the above-mentioned route of leakage 8, 14, etc. is kept in a condition which prevents the flow of air from the suction side to the discharge side by means of a film of the fuel oil and the like, and where there is no possibility of the outflow of the liquid when the pump is not operating since the feed liquid tank is located at a position lower than the position of installation of the pump. The load of the spring 7 biasing the check valve 6 is set in advance so that the valve 6 is opened at a pressure greater than a pressure at which the discharge valve 26 is opened, and the check valve 6 is opened after the liquid is discharged from the discharge valve 26.

In FIG. 1, the reference numeral 2 designates a communicating duct which communicates with the inside of the chamber of a check valve 26 on the discharge side, and the numeral 3 is an annular groove formed around the outer circumference of the discharge joint coupling 16 and communicating with the above-mentioned communicating duct 2. The reference numeral 4 is a communicating duct that communicates the annular groove 3 with the discharge port 23 as well as with the communicating duct 5.

The action and effects of the electromagnetic plunger pump equipped with the boost-retarding device having the above-described construction of the present invention will be fully explained in the following paragraph.

When a pulse current is impressed to a coil 34 of the pump, an electromagnetic plunger 33 and a discharge plunger 30 that have previously been kept balanced and stationary by a return spring 31 and an auxiliary spring 32 cause reciprocating motion inside a plunger case 35 and a cylinder 29, respectively, and suck the fluid from the suction port 24. The liquid thus sucked reaches the discharge port 23 and the communicating duct 5 en route to the suction valve 25, a side hole 27 of the suction valve chamber, a pressure chamber 28, the discharge valve 26, the communicating duct 2, the annular groove 3 and the communicating duct 4. Since an injection nozzle (not shown) is connected to the discharge side of the pump, the discharge quantity is restricted and the inner pressure of the pump gradually increases.

In this process, the check valve 6 is first opened. As the valve 6 opens, the liquid flows into the cylinder 11 and the discharge pressure is applied to the edge surface on the discharge side of the plunger 10. Because the communicating ducts 8, 14 communicating the discharge side with the suction side are provided to the plunger 10, a pressure in proportion to the transmission characteristics of the leak holes 8, 14 is transmitted to the suction side and this pressure is applied as a pressing force to the edge surface on the cushion side of the plunger 10. Using the pressure difference between the discharge pressure and the pressure on the suction side as its substantial pressing force, therefore, the plunger 10 moves to the right in the drawing inside cylinder 11 against the resiliency of the adjusting spring 18 until finally it butts against the valve 17 which concurrently functions as a stopper, and closes the valve seat 15. At this instant, its right movement is also stopped.

The interval from the start of the rightward movement of the plunger 20 till it closes the valve seat 15 corresponds to a boost-retarding period in which the pressure rise of the discharge pressure is slowly retarded. If the adjusting spring 18 is unvariable, this time-lag is determined by the speed of movement of the plunger 10 and the distance of its movement till it closes the valve seat 15, that is to say, the distance of gap between the valve seat 15 and the valve 17 as a stopper.

The speed of movement of the plunger 10 is determined by the transmission characteristics of the leak holes 8, 14 or a leakage per unit time of the liquid flowing from the discharge side to the suction side through the leak holes 8, 14. The leakage is adjusted by a minimum open area of the leak holes 8, 14.

In this embodiment, the leakage between the discharge side and the suction side is adjusted by adjusting the open area defined between the valve seat 9 provided to the leak hole 8 and the adjusting valve 12. In other words, the speed of movement of the plunger 10 is substantially controlled by adjusting the pressing force applied to the plunger 10. Namely, when the adjusting valve 12 is turned in the direction of decrease of the open area, the leakage is reduced between the discharge side and the suction side. Hence, the speed of movement to the right of the plunger 10 becomes greater and the boost-retarding time becomes shorter. In contrast, when the adjusting valve 12 is turned in the direction of increase of the open area, the speed of rightward movement of the plunger becomes smaller and the boost-retarding time becomes longer. In this manner, it is possible to easily and reliably set the boost-retarding time to a desired value by adjusting the adjusting valve 12 so as to thereby control the leakage between the discharge side and the suction side.

Next, the distance of rightward movement of the plunger 10 can be controlled by turning and adjusting the valve stem 20 functioning also as a stopper from the outside so as to cause retractile movement of the valve 17 disposed at the tip thereof and thus adjust the distance between the valve 17 and the valve seat 15. As mentioned above, the adjustment of this distance of movement permits the easy and reliable setting of the boost-retarding time to a desired value. Incidentally, the longer the distance of movement, the greater the quantity of deflection of the adjusting spring 18. Hence, the load applied to the plunger 10 becomes greater in such a case and the discharge pressure at the time of closing of the valve that balances with it also increases to the same extent. However, the adjusting spring 18 is selected in advance so that the discharge pressure of the pump exhibits a gradual increase in the range lower than a predetermined low pressure until the valve seat 15 is closed.

The leakage fluid flowing into the suction side is fed back to the suction port 24 through the communicating duct 22. When the valve seat is closed by the valve 17 functioning as a stopper, the discharge pressure of the pump causes a rapid increase, reaches a predetermined constant level and is then stabilized.

The curve a in FIG. 5 represents the discharge pressure characteristics of this embodiment wherein the discharge pressure P ($kg/cm^2$) is plotted on the ordinate and the time t (seconds) from the start of operation of the pump is plotted on the abscissa. The point P' on the curve a indicates a coordinate of the valve seat 15 closed by the valve 17.

The curve a' (chain line) represents the discharge pressure characteristics of this embodiment in which the closing time of the valve seat 15 is quickened and the point P'' indicates a coordinate of the valve seat 15 when it is closed.

The curve b represents the discharge pressure characteristics of the plunger of a boost-retarding valve which is similar to the cut-off valve for an electromagnetic plunger pump disclosed in Japanese patent application No. 20,322/1977, but it is not equipped with the leak hole 8 and the valve seat 15.

The curve c represents the discharge pressure characteristics of the apparatus which is not absolutely equipped with the boost-retarding device.

FIG. 2 illustrates another embodiment of the boost-retarding device in accordance with the present invention. In this embodiment, the leak hole 8 is provided so as to penetrate through the plunger 10 and is not equipped with the flow control mechanism as shown in FIG. 1. However, the transverse cross-sectional area of the leak hole 8 is minimized and its length of passage is made relatively long in order to enhance a fluid resistance against the leakage fluid. The speed of rightward movement of the plunger 10, hence, the boost-retarding time, is determined by this fluid resistance. If the discharge flow volume, a leakage and a viscosity of the pressure feed liquid are already given, and if the boost-retarding time of a predetermined range is also given, the transverse cross-sectional area of the leak hole 8 and its route length may be pre-set in order to delete a flow control valve.

Another feature of this embodiment is that the device has a spring adjusting mechanism which adjusts the deflection of the adjusting spring 18. Namely, the adjusting spring 18 is interposed under compression between the plunger 10 and the spring seat rod 20. Rod 20 may be moved in the axial direction within the cylinder 11 to control the deflection of the adjusting spring 18.

In the embodiment of FIG. 1, control of the deflection of the adjusting spring 18 changes the load applied to the plunger in the discharge direction. Accordingly, at the closing of the valve seat 15, the discharge pressure can be controlled by adjusting the deflection of the adjusting spring 18. Incidentally, the spring control mechanism is not limited to the construction in which the valve stem 20 is equipped with the adjusting spring seat. Namely, a separate adjusting spring seat may be provided retractilely in the axial direction of the cylinder 11. It may also be possible, for example, to let the valve cover 19 function as an adjusting spring seat rod.

Still another feature of this embodiment is that the aforementioned check valve 6' is formed by the plunger 10 in combination with the adjusting spring 18. That is to say, the valve seat **5*a* is formed by arranging the communicating duct 5' communicating with the discharge port 23' to open to the discharge side of the cylinder 11, and the valve 6' on the edge surface of the plunger 10 on the discharge side is engaged with the above-mentioned valve seat by means of the biasing force of the adjusting spring 18 to thereby form the check valve. Hence, this construction is more simplified than in the embodiment shown in FIG. 1**.

FIG. 3 illustrates still another embodiment of the boost-retarding device in accordance with the present invention.

The first feature of this embodiment is that the leak passage is formed as a leak groove 8' of an extremely narrow cross-sectional area formed around the outer circumference of the plunger 10. In the same way as in the leak hole 8 shown in FIG. 2, the fluid resistance of this leak groove 8' provides control of the moving speed of the plunger 10 and hence, the boost-retarding time.

Another method of adjusting the boost-retarding time by varying the fluid resistance is to form the groove 8' helically around the outer circumference of the plunger 10 (as shown in FIGS. **3*b* and 3*c***) so as to adjust its length and thus adjust the fluid resistance.

Without providing the leak hole or the leak groove, it is possible to properly select a clearance formed between the plunger 10 and the cylinder 11 and permit this clearance to function as the leak hole (FIG. **3*d*). From the fundamental concept that the leak route may function as well as a liquid route communicating the discharge side with the suction side, it is also possible to communicate the discharge side and the suction side with each other by the communicating duct bored on the main body 1 or by an external piping arrangement (FIG. 4'**), and to let the resulting passage function as the leak route.

The second feature of this embodiment is that it has a buffer-accumulator mechanism which allows the plunger 10 to cause fine sliding reciprocation in accordance with the discharge pulsation of the pump after the above-mentioned valve mechanisms 15', 17' are closed. Namely, a cavity 37 is bored on the edge surface on the suction side of the plunger and a valve-retaining body 36 is reciprocatingly fitted inside the cavity 37 and restricted by a compression spring 38 while a communicating duct 39 is arranged to open a plug 41 screwed to the edge section of the cylinder 11 and to communicate with the suction port 24 via communicating ducts 40 and 22.

The mode of operation of this buffer-accumulator mechanism is as follows. Upon being applied with the discharge pressure, the plunger 10 moves to the right whereby the valve 17 of the valve-retaining member 36 butts the valve seat 15' and closes the same. As soon as the valve seat 15' is closed, the discharge pressure causes a rapid increase and causes the plunger to move further to the right. Along with this rightward movement of the plunger 10, the spring 38 causes deflection together with the adjusting spring 18, and the deflection load of the spring 38 keeps the valve seat 15' continuously pressed and closed.

The rightward movement of the plunger 10 stops at a position at which the deflection load of the adjusting spring 18 and the spring 38 balances the discharge pressure, and the discharge pressure of the pump is thus stabilized. After the discharge pressure becomes stable, the discharge pulsation occurs in the pump. When the pressure on the discharge side applied to the plunger 10 causes fluctuation, the plunger 10 causes fine reciprocation inside the cylinder 11 while it is being applied with the load of the spring 38 and the adjusting spring 18, thereby smoothing the discharge pulsation of the pump, functioning as a buffer as well as an accumulator and thus enhancing the efficiency of the pump.

The third feature of this embodiment is that unlike the embodiments shown in FIGS. 1 and 2, the valve 17' is disposed on the plunger 10 and the valve seat 15' is formed by allowing the communicating duct 39 communicating with the suction port 24 to open to the edge surface of the valve cover (or the plug) 41. The valve 17' and the valve seat 15' are a pair of relative elements to each other and, consequently, are replaceable.

FIG. 4 illustrates still another embodiment of the boost-retarding device in accordance with the present invention.

The first feature of this embodiment is that the leak passages 8'', 14' are bored in the main body 1 and their open area is adjustable by means of the valve seat 9' provided to the leak passage 8'' and the adjusting screw 12' screwed to the main body 1. The action and effects of this arrangement as a flow control mechanism for adjusting a leakage from the discharge side to the suction side are the same as those described in the preceeding paragraphs.

The second feature of this embodiment is that a pressure-governing mechanism for stabilizing a constant discharge pressure is formed by boring an escape hole 42 at the principal section on the inner wall of the cylinder 11 to communicate with the suction side of the pump so that a variable orifice valve action is performed between this opening and the plunger 10 after the cut-off action of the valve seat 15' and the valve 17'.

Next, the action of this pressure-governing mechanism will be explained. Along with the rise of the discharge pressure of the pump, the plunger 10 moves inside the cylinder 11 towards the suction side whereby the valve 17' closes the valve seat 15' and cuts off the leak route to the communicating duct 22 that communicates with the suction port 24. When the discharge pressure pump further increases and exceeds a predetermined discharge pressure, the shoulder **10*b* on the discharge side of the plunger 10 reaches the opening of the above-mentioned escape hole 42, whereby the opening and the shoulder 10*b* together perform the variable orifice valve action and return an excessive pressure flow of the pump to the suction port 24 of the pump from the escape hole 42 through the communicating duct 22. Consequently, the constant discharge pressure of the pump is stabilized at a pressure which is proportional to the resiliency of the adjusting spring 18** due to its deflection.

The third feature of the embodiment is that it is furnished with a spring adjusting mechanism which enables adjustment of the deflection of the adjusting spring 18 and thus adjustment of the constant discharge pressure of the pump. Namely, a plug 41' pressing the adjusting spring 18 is screwed to the main body retractiley in the axial direction of the cylinder 11 so that the deflection of the adjusting spring 18 is adjusted by turning and adjusting the plug 41'. When deflection of the adjusting spring 18 is adjusted, the discharge pressure causing the variable orifice valve action is caused to vary along therewith. It is therefore possible to easily set the constant discharge pressure to a desired value.

When deflection of the adjusting spring 18 is adjusted by turning and adjusting the plug 41' in this embodiment, the distance also varies simultaneously between the valve 17' and the valve seat 15'. For this reason, it is also possible to vary the boost-retarding time and the discharge pressure at the time of closing of the valve, that is, the point P' or P'' of the curve a or a' in FIG. 5.

The fourth feature of this embodiment is that, in place of forming the above-mentioned valve mechanism by arranging the valve 17' to oppose the valve seat 15', the mechanism is formed by opening the edge section of the leak passages 8'', 14' on the suction side to the principal section on the inner wall of the cylinder 11 to thereby define a piston valve (variable orifice valve) between the opening and the shoulder **10*a* of the plunger 10 on the suction side. In this valve mechanism, the shoulder 10*a* of the plunger 10 moves to the opening and closes the same during the boosting process of the pump whereby the outflow of the leakage from the discharge side to the suction side is cut off in the same way as the cut-off action of the aforementioned valve 17' when it closes the valve seat 15'. Accordingly, this embodiment eliminates the valve 17' and the valve seat 15'** and effectively simplifies the construction of the boost-retarding device.

In this embodiment, the boost-retarding time can easily be set to a desired value by turning and adjusting the flow adjusting valve 12'. The same effect can also be obtained easily by changing the open position of the communicating duct 14' on the inner wall of the cylinder 11 along the axial direction of the same so as to vary the distance of movement of the plunger before closing of the valve.

When the plunger 10 moves toward the suction side until the constant discharge pressure of the pump is attained and the adjusting spring 18 is contracted as it is being applied with the discharge pulsation of the pump, the outer circumferential surface of the plunger 10 keeps closing the opening of the communicating duct 14' and causes the buffer and accumulator action without problem.

Since the valve 17' and the valve seat 15' can be eliminated in this embodiment, the plug 41' may be replaced by a spring adjusting mechanism such as shown in FIG. 2 for adjusting the adjusting spring 18. In such a case, the valve 17 shown in FIG. 2 is, of course, unnecessary.

It is not always necessary to bore the cylinder 11 inside the main body 1. For example, a cylinder integrated with or secured to the plug 41', or secured to the discharge joint coupling 16, may be inserted into or directly mounted to the main body 1 and then secured thereto. The escape hole 42 communicating the communicating duct 22 and the leak hole 14' communicating with the leak hole 8'' may be optionally formed on this cylinder.

The boost-retarding device in accordance with the present invention is characterized by including the cylinder communicating the suction side and the discharge side of the pump; the plunger slidably and reciprocatingly fitted into the cylinder; the leak passage communicating the suction side and the discharge side divided by the plunger; the adjusting spring biasing the plunger toward the discharge side; and the valve mechanism cutting off the outflow of the liquid from the discharge side to the suction side due to movement of the plunger toward the suction side. By means of its leak passage, the invention enables a controlled transmission of pressure from the discharge side to the suction side by means of the leak passage, thereby adjusting the moving speed of the plunger, and thus setting the boost-retarding time of the discharge pressure to an optional level. The present device also makes it possible to cut off the outflow of the liquid from the discharge side to the suction side by its valve mechanism and to stably elevate the discharge pressure to a constant pressure which is determined by the adjusting spring.

The boost-retarding device having the above-mentioned construction of the invention is also characterized by the fact that it is furnished with the flow adjusting mechanism which adjusts the flow quantity flowing from the discharge side to the suction side at the time of operation of the plunger. It is therefore possible to easily adjust the moving speed of the plunger and, thus to easily and reliably set the boost-retarding time to a desired value in an effective manner.

The boost-retarding device of the invention is further provided with the distance adjusting mechanism for adjusting the moving distance of the plunger toward the suction side till the valve mechanism causes the cut-off action. This mechanism permits easy and accurate setting of the boost-retarding time to a desired value and, at the same time, permits easy and stable setting of the discharge pressure to an optional value by way of controlling deflection of the adjusting spring at the time the valve is closed.

An electromagnetic plunger pump equipped with the boost-retarding device in accordance with the present invention is therefore capable of catching an optimum ignition timing when the injection discharge pressure from the nozzle becomes most suited for the ignition, and reducing the ignition noise to a marked extent.

Incidentally, it has been believed in the art that in order to effectively restrain the ignition detonation noise in an ordinary gun-type burner, the injection pressure at the time of ignition and at the time of normal burning should be maintained at about 70–80% of the standard injection pressure 7 kg/cm$^2$ (100 psi). Improvements in the burner and fire chamber in recent years allow ignition at an injection pressure of lower than 3 kg/cm$^2$. Hence, the ignition detonation noise will be further reduced in the future.

Since the electromagnetic plunger pump equipped with the boost-retarding device of the present invention can remarkably reduce the ignition detonation noise, it is especially suitable for applications where the ignition detonation noise poses a serious problem, e.g., hot water boiler, a hot water supply, etc. for home use.

Furthermore, since the boost-retarding device in accordance with the present invention is furnished with the spring adjusting mechanism for adjusting deflection of the adjusting spring in addition of the above-mentioned construction, it is possible to set the discharge pressure at a desired value at the time of cut-off action of the above-mentioned valve mechanism, to adjust the boost-retarding time in accordance with the discharge pressure, to effect ignition at an optimum ignition timing when the injection pressure of the nozzle reaches such a level and thus to remarkably reduce the ignition detonation noise.

The device of this invention is further equipped with the buffer-accumulator mechanism which permits the fine sliding reciprocation of the plunger in accordance with the discharge pulsation of the electromagnetic plunger pump after the cut-off action of the above-mentioned valve mechanism. In other words, the device of the invention also functions as an accumulator and remarkably improves the efficiency of the pump.

In the above-mentioned construction, the device of the present invention is further equipped with the constant discharge pressure-adjusting mechanism by arranging the communicating duct communicating with the suction side of the pump to open at the principal section on the inner wall of the cylinder so as to define a variable orifice valve mechanism between the opening of this communicating duct and the plunger after the cut-off action of the valve mechanism. It is therefore possible to stabilize the constant discharge pressure to a predetermined level.

In addition to the above-mentioned mechanism, the device of the invention is further equipped with the spring adjusting mechanism for adjusting the deflection of the above-mentioned adjusting spring. When the above-mentioned variable orifice valve mechanism causes its closing action, the deflection of the adjusting spring is adjusted so that the constant discharge pressure balancing therewith can be stabilized and set to a desired value.

The check valve is also incorporated in the above-mentioned construction between the discharge side of the pump and the cylinder to close the discharge side. This valve stabilizes the sucking and discharge action of the pump at the start of operation and at the same time effectively prevents the overflow of the fuel oil from the suction side of the pump to the discharge side into the fire chamber when the pump stops operating.

As can be clearly appreciated from the above-mentioned construction, no residual pressure is left on the discharge side of the pump when the pump stops operating. Hence, no "after-drip" of the fuel oil from the injection nozzle takes place, and the plunger of the boost-retarding device of the invention is allowed to return to the correct position when the pump stops operating and ensures the correct boost-retarding time when the pump is again actuated.

As described in detail in the foregoing paragraphs, the boost-retarding device in accordance with the present invention permits easy setting of the boost-retarding time and the discharge pressure at the time the valve is closed. This provides the boost-retarding time, to optional values, easy selection of an optimum ignition timing, reduction of the ignition detonation noise, improvement of the pump efficiency, stabilization of the constant discharge pressure, safe operation of the pump at the start and prevention of overflow of the fuel pump into the fire chamber when the pump stops operating and prevention of so-called "after-drip" of the fuel from the injection nozzle. Hence, the device of the present invention provides great industrial advantages. Additionally, the boost-retarding device in accordance with the present invention can be adapted not only to the electromagnetic plunger pump, but also to reciprocating pumps and gear pumps of varying types.

It is understood that the foregoing disclosure is given by way of illustrative example only, rather than by way of limitation, and that without departing from the invention, the details may be varied within the scope of the appended claims.

I claim:

1. A boost-retarding service for a pump which comprises a main body containing a cylinder means having a suction side and a discharge side; plunger means slidably and reciprocatingly fitted into said cylinder means; leak passage communicating means extending from said suction side to said discharge side; said passage being divided by said plunger; adjustable spring means for biasing said plunger means toward said discharge side; and valve means for cutting off an outflow of fluid from said discharge side to said suction side responsive to movement of said plunger means toward said suction side.

2. The boost-retarding device as defined in claim 1 wherein said leak passage communicating means is a sliding gap between said cylinder means and said plunger means.

3. The boost-retarding device as defined in claim 1 wherein said valve means comprises a valve seat formed in said leak passage communicating means and open to an edge surface of said plunger means on said suction side, and valve means located opposite said plunger means on said suction side with a gap normally formed between said plunger means and said valve seat.

4. The boost-retarding device as defined in claim 1 wherein said valve means is formed by arranging the edge section on said suction side of said leak passage disposed outside said plunger means for by-passing the leak passage to open to the inner wall of said cylinder means on said suction side so that the resulting opening and said plunger together define a variable orifice therebetween.

5. The boost-retarding device as defined in claim 1 wherein said leak passage communicating means is formed in said plunger means.

6. The boost-retarding device as defined in claim 5 wherein said leak passage communicating means is bored through said plunger means to penetrate therethrough.

7. The boost-retarding device as defined in claim 5 wherein said leak passage communicating means is formed around the outer circumference of said plunger means.

8. The boost-retarding device as defined in claim 7 wherein said leak passage communicating means is a helical groove formed around the outer circumference of said plunger means.

9. The boost-retarding device as defined in claim 1 wherein said leak passage communicating means by-passes said plunger means.

10. The boost-retarding device as defined in claim 9 wherein said leak passage communicating means is formed in said main body.

11. The boost-retarding device as defined in claim 9 wherein said leak passage communicating means is partially constructed by an external piping arrangement.

12. The boost-retarding device as defined in claim 1 wherein said valve means is disposed on an edge surface of said plunger means on said suction side, and valve seat means located opposite the direction of movement of said plunger means and on said suction side with a gap formed between said plunger means and said valve.

13. The boost-retarding device as defined in claim 12 wherein said valve seat means is formed by an opening in a communicating duct which communicates with said suction side.

14. The boost-retarding device as defined in claim 12 wherein said valve seat means is formed by opening the edge section of said leak passage communicating means on said suction side.

15. A boost-retarding device for a pump including: a cylinder means having a suction side and a discharge side; reciprocatingly slidable plunger means in said cylinder means; leak passage communicating means around said plunger means and extending between said suction and said discharge sides; an adjustable spring biasing means for urging said plunger means toward said discharge side; and valve means for cutting off an outflow of a fluid from said discharge side to said suction side, whereby said outflow may be avoided when there is a movement of said plunger means toward said suction side; said boost-retarding device further comprising check valve means formed between said discharge side of said pump and said cylinder, said check valve means normally closing said discharge side.

16. The boost-retarding device as defined in claim 15 wherein said check valve means comprises a valve seat formed by opening a communicating duct communicating with said discharge side, valve means engaging said valve seat and closing the same, and push spring biasing means normally urging said valve means into a pressure contact with said valve seat.

17. The boost-retarding device as defined in claim 16 wherein said valve means includes said plunger means and said push spring biasing means includes a check valve used with said adjustable spring.

18. A boost-retarding device for a pump including: cylinder means having a suction side and a discharge side divided by a plunger means; said plunger means slidably and reciprocatingly fitting within said cylinder means; leak passage communicating means extending between said suction side and said discharge side; an adjusting spring biasing means normally urging said plunger means toward said suction side; said boost-retarding device further including flow adjusting means for adjusting the rate of fluid flowing from said discharge side to said suction side responsive to an operation of said plunger means.

19. The boost-retarding device as defined in claim 18 wherein said flow adjusting means includes a valve for adjusting leakage in said leak passage communicating means.

20. The boost-retarding device as defined in claim 19 wherein said flow adjusting means comprises a valve for adjusting the area of said leak passage communicating means, of a passage bored in said plunger.

21. A boost-retarding device for a pump including: cylinder means having a suction side and a discharge side; plunger means slidably and reciprocatingly fitted into said cylinder means to divide said suction side from said discharge side; leak passage communicating means extending between said suction side and said discharge side; an adjustable spring biasing means for urging said plunger toward said discharge side; valve means for cutting off an outflow of a fluid from said discharge side to said suction side responsive to movement of said plunger means toward said suction side; and means for adjusting the distance of movement of said plunger means toward said suction side until said valve means cuts off said outflow.

22. The boost-retarding device as defined in claim 21 wherein said movement distance adjusting means comprises valve seat means formed by an opening of said leak passage facing an edge surface on said suction side of said plunger means, and valve means which is retractile in the axial direction of said cylinder means opposing said valve seat with a gap therebetween.

23. The boost-retarding device as defined in claim 22 wherein said valve means has a valve stem which is retractile in the axial direction of said cylinder means to a valve cover which closes the edge section of said cylinder.

24. A boost-retarding device for a pump including: cylinder means having a suction side and a discharge side divided by a plunger means; said plunger means being slidably and reciprocatingly fitted within said cylinder means; leak passage communicating means extending between said suction side and said discharge side; adjustable spring biasing means for urging said plunger toward said discharge side; valve means for cutting off an outflow of a fluid from said discharge side to said suction side responsive to movement of said plunger means toward said suction side; and spring adjusting means for adjusting the deflection of said adjusting spring.

25. The boost-retarding mechanism as defined in claim 24 wherein said adjustable spring is interposed under compression between an edge surface of said plunger means on said suction side and a spring seat rod which is retractile in the axial direction of said cylinder means and opposed to said edge surface of said plunger means with a gap therebetween.

26. The boost-retarding device as defined in claim 25 wherein said spring seat rod is a valve cover closing an edge section of said cylinder means.

27. The boost-retarding device as defined in claim 25 wherein said spring seat rod is a valve stem retractilely mounted for movement in the axial direction of said cylinder means.

28. A boost-retarding device for a pump including: cylinder means having a suction side and a discharge side divided by a plunger means; said plunger means being slidably and reciprocatingly fitted into said cylinder means; leak passage communicating means extending between said suction side and said discharge side; an adjustable spring for biasing said plunger means toward said discharge side; and valve means for cutting off an outflow of a fluid from said discharge side to said suction side responsive to movement of said plunger means toward said suction side; and buffer-accumulator means for enabling a fine sliding reciprocation of said plunger means in response to the discharge pulsation of said pump after the operation of said cut-off valve means.

29. The boost-retarding device as defined in claim 28 wherein said buffer-accumulator means comprises a valve-retaining member fitted against the edge section of said plunger means on said suction side; spring means for restricting said valve-retaining member while enabling it to reciprocate in the axial direction of said plunger means, and valve seat means formed by a communicating duct extending from said suction side in order to open a valve cover closing the edge surface section of said cylinder means after said valve-retaining member closes said valve seat, said plunger means having a fine sliding reciprocation in response to the discharge pulsation of said pump while it is loaded by said adjusting spring.

30. A boost-retarding device for a pump including: a cylinder means having a suction side and a discharge side divided by a plunger means, said plunger means being slidably and reciprocatingly fitted into said cylinder means; leak passage communicating means extending between said suction side and said discharge side; an adjusting spring biasing means for urging said plunger means toward said discharge side; and valve means for cutting off an outflow of a fluid from said discharge side to said suction side; constant discharge pressure adjusting means formed by a communicating duct having an opening toward the principal section on the inner wall of said pump and communicating with said suction side so that the resulting opening and said plunger means together form a variable orifice valve means therebetween after the operation of said cut-off valve means.

31. The boost-retarding device defined in claim 30 including a spring adjusting means for enabling an adjustment of the discharge pressure of said pump to a desired value by adjusting deflection of said adjusting spring.

32. The boost-retarding device as defined in claim 30 including a buffer-accumulator means which enables said plunger means to make fine sliding reciprocation inside said cylinder means in accordance with the discharge pulsation of said pump responsive to contractions and extensions of said adjusting spring.

* * * * *